US006957757B1

(12) United States Patent
Huang

(10) Patent No.: US 6,957,757 B1
(45) Date of Patent: Oct. 25, 2005

(54) NAIL BOX OF A NAIL DRIVER

(76) Inventor: Hung-Ming Huang, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/822,291

(22) Filed: Apr. 12, 2004

(51) Int. Cl.[7] ..... B27F 7/00
(52) U.S. Cl. ..... 227/137; 227/136; 227/120; 206/338; 206/350
(58) Field of Search ..... 227/120, 130, 227/156, 137, 136; 206/338, 350, 405, 818

(56) References Cited

U.S. PATENT DOCUMENTS 3,330,462 A * 7/1967 Colechia et al. ..... 227/136
3,568,908 A * 3/1971 Bader ..... 227/127
3,945,551 A * 3/1976 Sato et al. ..... 227/136
4,319,705 A * 3/1982 Geist et al. ..... 227/120
4,433,782 A * 2/1984 Figge et al. ..... 206/338
4,600,135 A * 7/1986 Mukoyama ..... 227/120
5,146,701 A * 9/1992 Lee ..... 40/406
5,697,541 A * 12/1997 Burke et al. ..... 227/109
6,152,346 A * 11/2000 Laubach ..... 227/109

* cited by examiner

*Primary Examiner*—Stephen F. Gerrity
*Assistant Examiner*—Thanh Truong

(57) ABSTRACT

A nail box of a nail driver comprises a main casing; a lower side of the main casing being installed with a firmly secured with a first magnetic element; a sub-casing pivotally installed to the main casing as so to form a casing; a lower side of the sub-casing being formed with an inclined resisting portion; a receiving unit for receiving a plurality of nails; a lower side of the receiving unit being firmly secured with a second magnetic element; one lateral side of a lower portion of the receiving unit being formed with a push portion corresponding to the inclined resisting portion of the sub-casing. The receiving unit is installed below the main casing and received in the casing; the same polarity of magnetic elements of the receiving unit and the main casing are oppositely arranged so as to generate an impulsive force.

3 Claims, 6 Drawing Sheets

NAIL BOX OF A NAIL DRIVER

FIELD OF THE INVENTION

The present invention relates to nail drivers, and particular to a nail box of a nail driver, in that the installation of nails can be performed easily.

BACKGSEMI-ROUND OF THE INVENTION

In one prior art nail driver, a nail driver has a winding type nail box for receiving a plurality of nails. When it is desired to install nails, a retaining post at a lower side of the nail box must be detached so as to take the nail box out and then fill nails. Then the nail box is assembled to the nail driver and finally, the retaining post is fixed.

However, this prior art has a complex assembly process, especially for those not skilled in the operation. Moreover, even some elements will be lost or destroyed. Thereby, in filling nails, it is often that the nail driver is placed on the ground or table surface so that the two hands of the user can be used to the operation. However, this design is not a personality design.

SUMMARY OF THE INVENTION

Accordingly, the primary object of the present invention is to provide a nail box of a nail driver, in that the installation of nails can be performed easily.

To achieve above objects, the present invention provides a nail box of a nail driver comprises a main casing; a lower side of the main casing being installed with a first magnetic element; a sub-casing pivotally installed to the main casing as so to form a casing; a lower side of the sub-casing being formed with an inclined resisting portion; a receiving unit for receiving a plurality of nails; a lower side of the receiving unit being firmly secured with a second magnetic element; one lateral side of a lower portion of the receiving unit being formed with a push portion corresponding to the inclined resisting portion of the sub-casing. The receiving unit is installed below the main casing and received in the casing; the same polarity of magnetic elements of the receiving unit and the main casing are oppositely arranged so as to generate an impulsive force.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
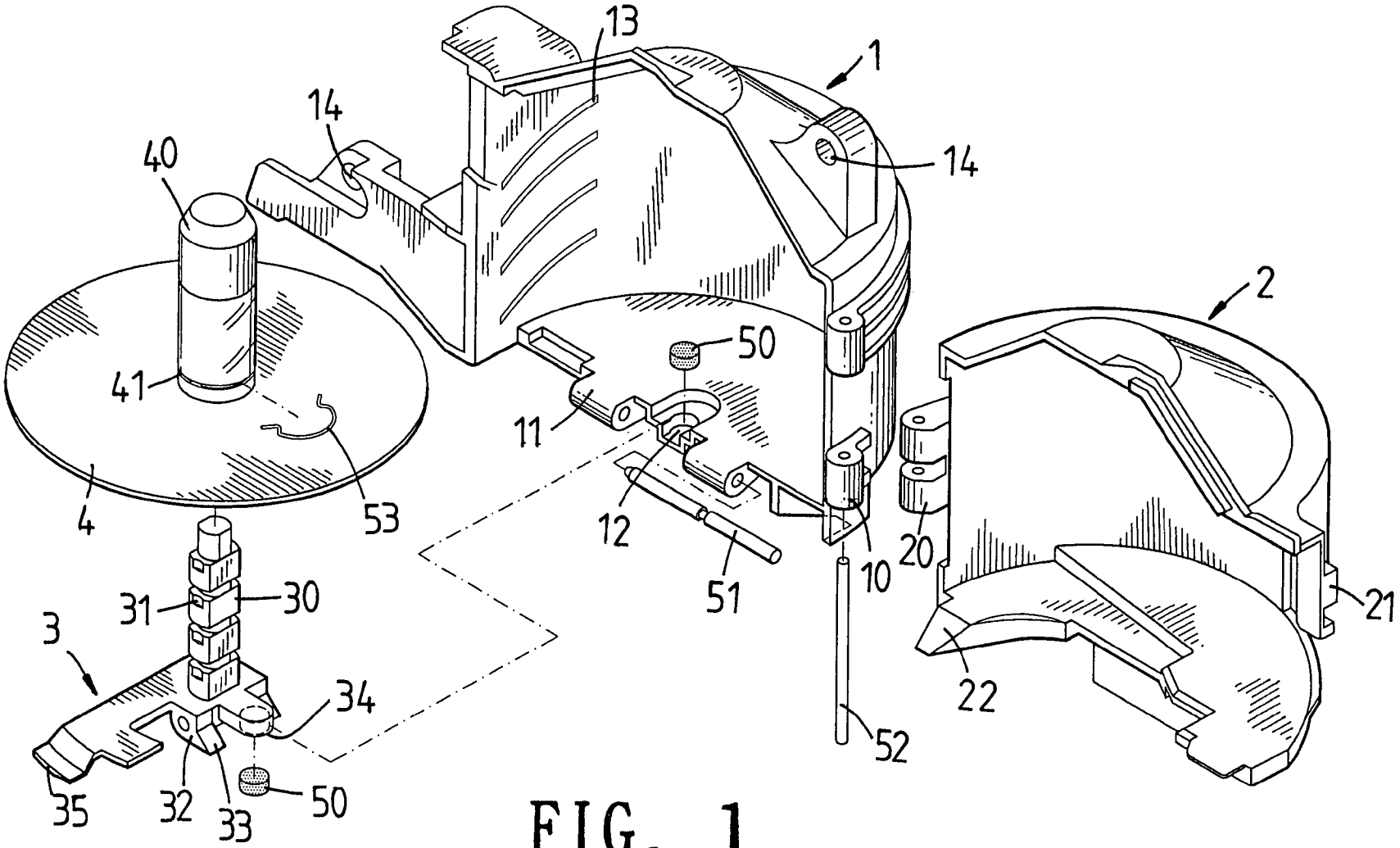
FIG. 1 is an exploded schematic view of the nail box of a nail driver according to the present invention.
Figure 2:
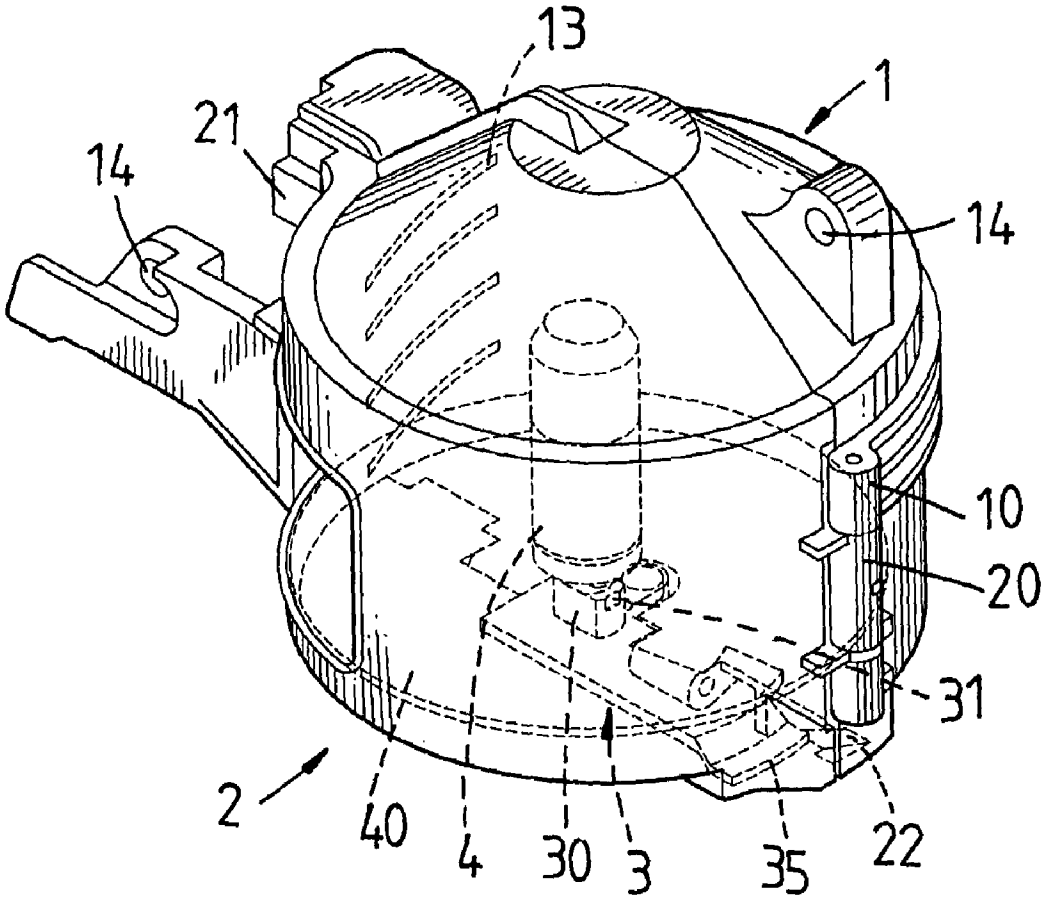
FIG. 2 is an assembled view of the nail box of a nail driver of the present invention.
Figure 3:
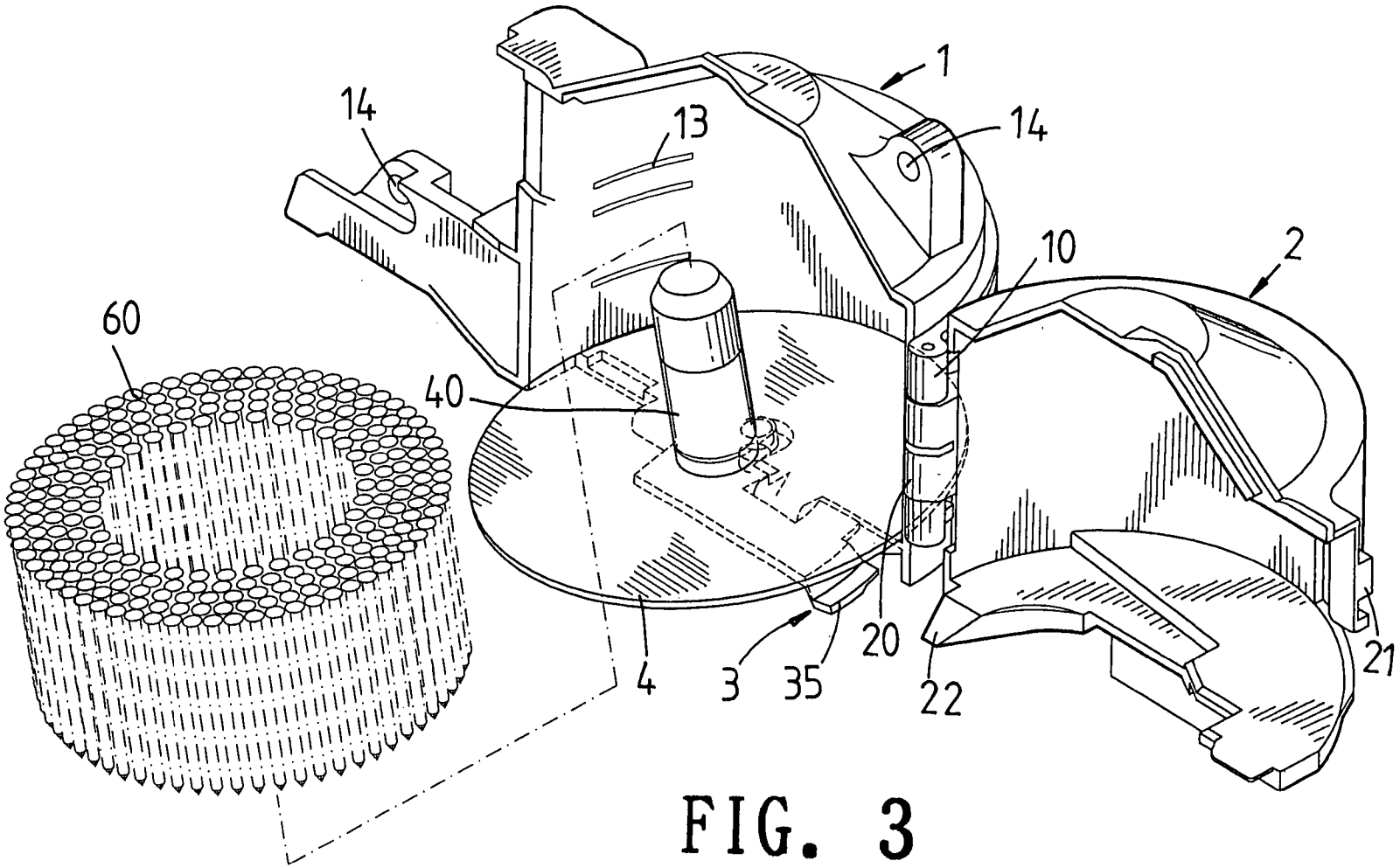
FIG. 3 is a schematic view showing the operation of the nail box of a nail driver of the present invention.
Figure 5:
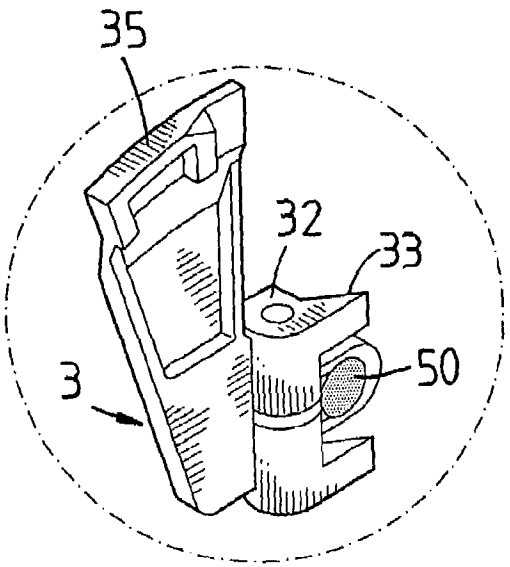
FIG. 5 is an enlarged view of the combining seat of the nail box of a nail driver according to the present invention.
Figure 4:
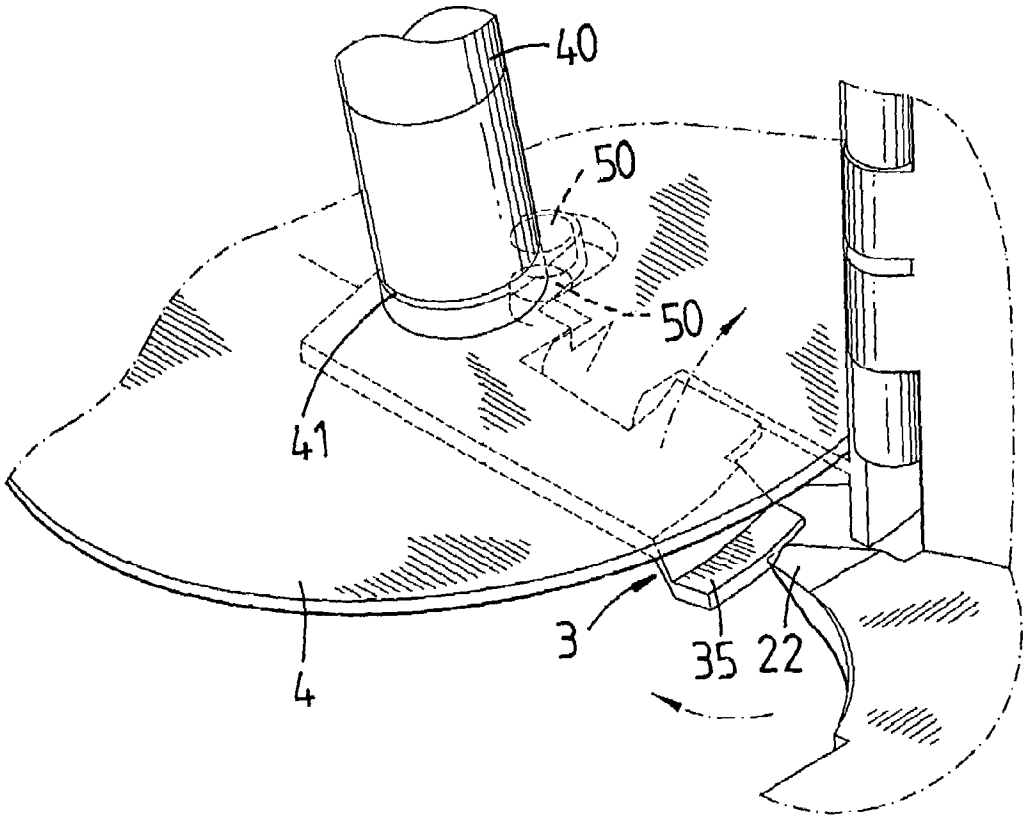
FIG. 4 is a schematic view showing the operation of the inclined resisting portion and the push portion of the present invention.
Figure 7:
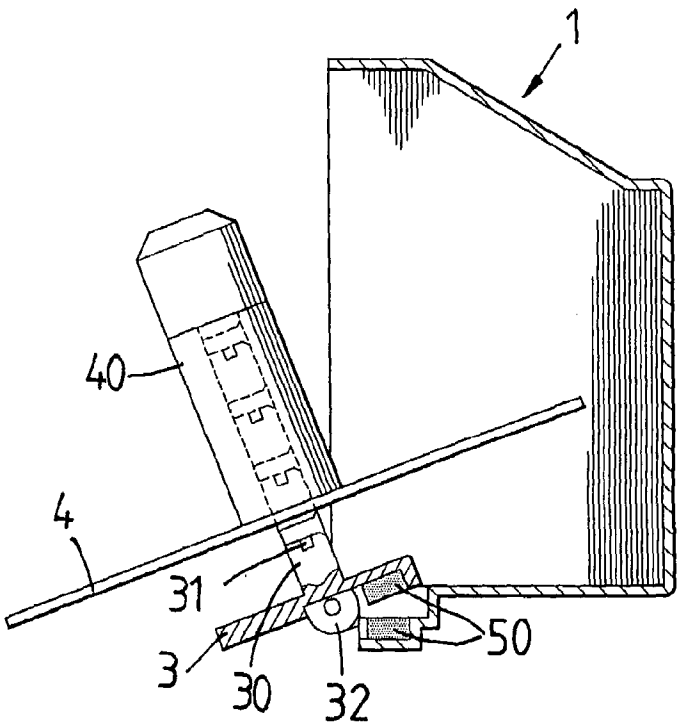
FIG. 7 is a cross section view of the nail box of a nail driver of the present invention.
Figure 6:
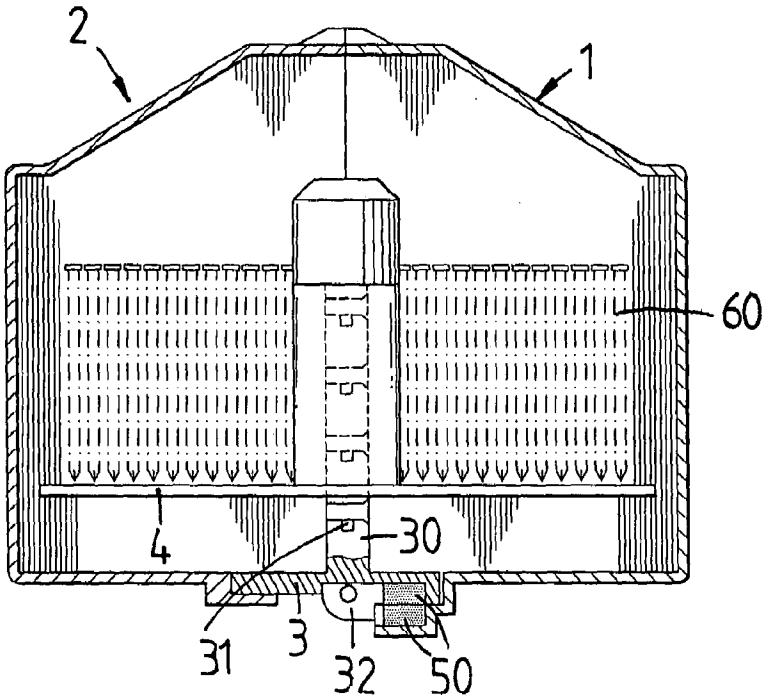
FIG. 6 is a cross section view about the nail box of a nail driver of the present invention.
Figure 8:
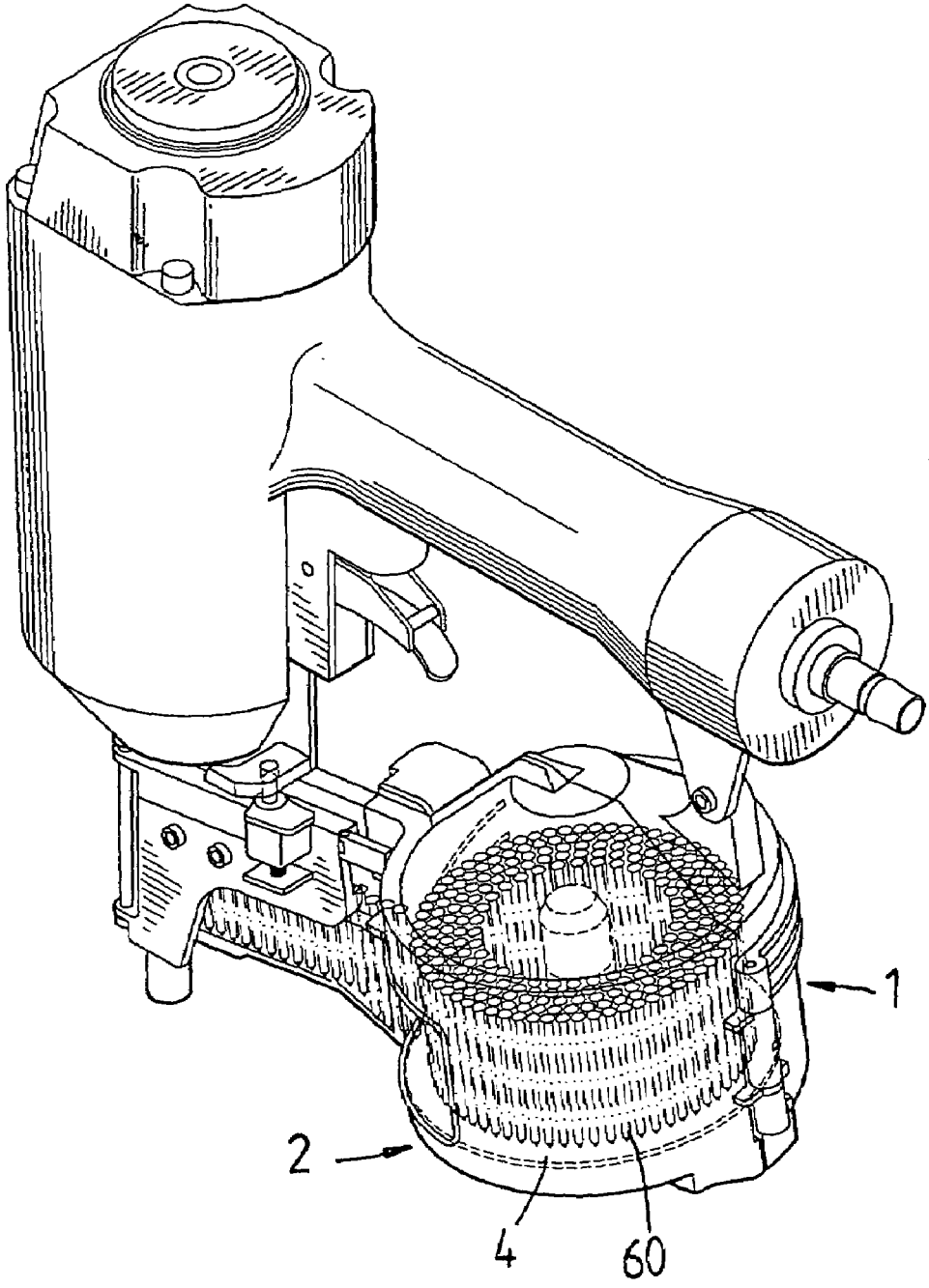
FIG. 8 is a schematic perspective view of the nail box of a nail driver of the present invention.

With reference to FIGS. 1, 2 and 8, the nail box of a nail driver of the present invention is illustrated. The nail box of the present invention has the following elements.

A casing includes a main casing 1 and a sub-casing 2. The main casing 1 is formed by an approximate semi-round cylinder. One side of the main casing 1 is protruded with a pivotal shaft portion 10. A lower end of the main casing 1 is protruded with a pivotal portion 11. A receiving hole 12 is formed in the pivotal portion 11. A magnetic element 50 is received in the receiving hole 12. An inner side of the main casing 1 has at least one scale line 13. An outer edge of the main casing 1 is protruded with two retaining holes 14 for buckling a nail driver.

The sub-casing 2 is formed by an approximate semi-round cylinder. One side of the sub-casing 2 is protruded with a pivotal shaft portion 20 corresponding to the pivotal shaft portion 10 of the main casing 1. Another side of the sub-casing 2 is formed with a buckling portion 21 for fixing the nail driver and for preventing the outward turning of the sub-casing 2. An inclined resisting portion 22 is formed at a lower side of the sub-casing 2 and below the pivotal shaft portion 10.

A receiving unit of the present invention includes a combining seat 3 and a receiving disk 4. The combining seat 3 is installed with a combining shaft 30 for receiving the receiving disk 4. The combining shaft 30 is formed with a plurality of adjusting grooves 31 arranged at different levels. One end of the combining seat 3 is installed with a pivotal portion 32 corresponding to the pivotal portion 11 of the main casing 1. A front end of the pivotal portion 32 is protruded with a receiving hole 34 for receiving a magnetic element 50. One lateral side of the combining seat 3 is formed with a push portion 35.

A center of the receiving disk 4 is installed with a combining portion 40 for coupling with the combining shaft 30 of the combining seat 3. A lower end of the combining portion 40 is installed with an annular slot 41 for receiving an annular hook 53.

In assembly of the present invention, the rotary shaft 52 passes through the pivotal shaft portions 10 and 20 of the main casing 1 and the sub-casing 2, respectively, so as to lock the main casing 1 with the sub-casing 2 to be formed as a casing of a nail box. Then the combining shaft 30 of the combining seat 3 is received into the combining portion 40. Then hook 53 is buckled to the annular slot 41 so that the hook 53 can clamp the adjusting groove 31. Then the combining seat 3 is assembled with the receiving disk 4. Finally, two magnetic elements 50 are received in the main casing 1 and the receiving holes 12, 34 of the combining seat 3. The same magnetic polarity of the two magnetic elements 50 face to each other. Then the pivotal shaft 51 serves to pivotally connect the pivotal portions 11, 32 of the main casing 1 and the combining seat 3, respectively.

In use of the present invention, the two retaining holes 14 of the main casing 1 are locked to a nail driver. Then the main casing 1 and sub-casing 2 are coupled. Then a nail driver is buckled to the buckling portion 21 of the sub-casing 2 so as to prevent the sub-casing 2 from turning. Then, the main casing 1 and sub-casing 2 are expanded. By the impulsive forces of the two magnetic elements 50, the combining seat 3 will turn toward an outer side of the main casing 1 along the pivotal shaft 51. The receiving disk 4 engaged to the combining seat 3 also turns outwards with the combining seat 3. Thereby, the user can fill nails 60 thereinto. When the combining seat 3 is turned to a predetermined angle, an inclined surface 33 of the pivotal portion 32 of the combining seat 3 will resist against a lower edge of the main casing 1 to prevent the combining seat 3 from over-turning outwards. At this moment, since the receiving disk 4 has turned outwards with a predetermined angle with the turning of the combining seat 3, the nails 60 can be easily received in the receiving disk 4. When nails 60 of different sizes are used, the scale line 13 within the main casing 1 can be used as a reference. The hook 53 of the combining portion 40 is hooked to a different adjusting groove 31 of the combining shaft 30 of the combining seat 3 so that the combining portion 40 is at a different elevation so as to be used with nail 60 of different length. When the nail 60 is placed in the receiving disk 4, the main casing 1 and sub-casing 2 are coupled, and the inclined resisting portion 22 of the sub-casing 2 will push the combining seat 3 and the combining portion 40 back to the main casing 1 along the inclined surface of the push portion 35 of the combining seat 3. When the main casing 1 and the sub-casing 2 are coupled completely, the combining seat 3 and the combining portion 41 will be pushed to be between the main casing 1 and sub-casing 2. Finally, the buckling portion 21 of the sub-casing 2 is locked by using the nail drive.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A nail box of a nail driver comprising:

a main casing; a lower side of the main casing including a first magnetic element;

a sub-casing pivotally installed to the main casing as so to form a casing; a lower side of the sub-casing being formed with an inclined resisting portion;

a receiving unit for receiving a plurality of nails; a lower side of the receiving unit including a second magnetic element; one lateral side of a lower portion of the receiving unit being formed with a push portion corresponding to the inclined resisting portion of the sub-casing;

wherein the receiving unit is installed below the main casing and received in the casing; the same polarity of the magnetic elements of the receiving unit and the main casing are oppositely arranged so as to generate an impulsive force which is used for separating the main casing and the receiving unit; the inclined resisting portion and the push portion serve to retain the receiving unit in the casing;

wherein a lower side of the receiving unit has an inclined portion for preventing the receiving unit from over-turning.

2. The nail box of a nail driver as claimed in claim 1, wherein an adjustable receiving disk is installed in the receiving unit for installing nails of different sizes.

3. The nail box of a nail driver as claimed in claim 2, wherein at least two scale lines are installed at an inner side of the main casing as a reference in adjustment of the receiving disk.

* * * * *